US008776437B2

(12) United States Patent
Bourgoin

(10) Patent No.: US 8,776,437 B2
(45) Date of Patent: Jul. 15, 2014

(54) CASEMENT WINDOW OPERATOR WITH FOLDING HANDLE

(71) Applicant: Roto Frank of America, Inc., Chester, CT (US)

(72) Inventor: Brian Bourgoin, East Haddam, CT (US)

(73) Assignee: Roto Frank of America, Inc., Chester, CT (US)

( * ) Notice: Subject to any disclaimer, the term of this patent is extended or adjusted under 35 U.S.C. 154(b) by 0 days.

(21) Appl. No.: 13/871,485

(22) Filed: Apr. 26, 2013

(65) Prior Publication Data

US 2013/0312331 A1 Nov. 28, 2013

Related U.S. Application Data

(60) Provisional application No. 61/638,727, filed on Apr. 26, 2012.

(51) Int. Cl.
*E05D 15/28* (2006.01)

(52) U.S. Cl.
USPC ..... 49/246; 49/248; 49/249; 16/429; 74/547; 74/543; 74/528; 292/336.3

(58) Field of Classification Search
USPC ..... 49/246–249; 292/336.3, 347, 348, 352, 292/354, 355, 359, DIG. 20, DIG. 31, 292/DIG. 47; 16/429; 74/528, 529, 536, 74/543–551, 557
See application file for complete search history.

(56) References Cited

U.S. PATENT DOCUMENTS 4,253,618 A * 3/1981 Beraut ..... 242/284
4,524,921 A * 6/1985 Ozaki et al. ..... 242/284
5,443,570 A * 8/1995 Hirano ..... 242/284
6,450,063 B1 * 9/2002 Harvey et al. ..... 74/547
6,598,265 B2 * 7/2003 Lee ..... 16/429
6,640,389 B2 * 11/2003 Van Klompenburg et al. . 16/429
7,066,505 B2 * 6/2006 Van Klompenburg et al. ..... 292/336.3
7,194,930 B2 * 3/2007 Dawson ..... 74/547
7,251,860 B2 * 8/2007 Liang et al. ..... 16/429
7,941,898 B2 * 5/2011 Liang et al. ..... 16/429
8,555,548 B2 * 10/2013 Carter ..... 49/249
2004/0074051 A1 * 4/2004 Dawson ..... 16/422
2005/0212305 A1 9/2005 Gill
2007/0273162 A1 11/2007 Schultz
2008/0066382 A1 3/2008 Erickson
2009/0256367 A1 10/2009 Schultz

* cited by examiner

*Primary Examiner* — Katherine Mitchell
*Assistant Examiner* — Marcus Menezes
(74) *Attorney, Agent, or Firm* — Miller, Matthias & Hull LLP

(57) ABSTRACT

An operator for a casement window is disclosed which includes a hub that frictionally receives a spindle. The hub is pivotally connected to a proximal end of a pivoting handle. The hub is disposed within a cavity that extends through the proximal end of the handle and terminates at a back wall. The cavity partially accommodates a biasing element, an actuator and the hub. The biasing element is disposed between the actuator and the back wall and biases the actuator towards the hub. The hub includes at least one open position recess and open position protrusion and the actuator includes a complementary protrusion and a recess wherein the protrusion is received in the at least one open position recess of the hub and the recess of the actuator receives the at least one open position protrusion of the hub when the handle is pivoted to the open position.

19 Claims, 4 Drawing Sheets

CASEMENT WINDOW OPERATOR WITH FOLDING HANDLE

TECHNICAL FIELD

This disclosure is directed to an operator for a window. More particularly, this disclosure relates to a folding window operator for use on a casement window.

BACKGROUND

Windows typically include a frame that supports a piece of glass. One common type of window is a casement window that can be found in commercial and residential applications. A casement window generally includes a window sash that is pivotally connected to a window frame so the window sash can be moved pivotally between an open position and a closed position. The frame typically supports a window operator that includes a rotary handle mated to a spindle that translates rotary motion of the handle into pivotal movement of one or more operator arms that are slidably connected to the window sash.

Typically, casement window operator handles extend outward from the frame into the room. The rotary handle may have structure such that it can be articulated between an open position where the handle extends outward from the frame for use and a closed or folded position where the handle may lie along the base or housing of the operator as shown in US20090256367 (see FIGS. 15, 18, 21, 24 and 27). Such folding handles for window operators are known in the art.

Typical folding handles for casement window operators are designed to pivot about 135° between the closed and open position. The homeowner operates the handle by gripping a knob connected to the distal end of the handle. Unfortunately, there is a tendency for the handle to pivot or rotate back to the closed position during operation of the handle in the open position, particularly when a heavy input load is being transmitted, for example, in the case of a heavy or misaligned window sash. This condition is created by the fact that the knob disposed at the distal end of the handle and the axis of rotation of the handle are not in the same plane. As the homeowner's hand rotates the handle via the knob, the wrist action acts to pull the handle back down to the closed position.

This disclosure seeks to overcome this disadvantage and to provide one or more new features not previously available.

SUMMARY

The disclosed casement window operator incorporates a lockout feature that keeps the handle in the open (or upright) position during use of operator to open or close the window sash. As the combination of a heavy input load and the action of the home owner's wrist on the knob of the handle impose forces on the handle which would cause the handle to move from its open to its closed or folded position, the lockout feature will block any folding of the handle from the open position towards the closed or folded position. The lockout feature may be provided in the form of an actuator that is biased towards engagement with a hub. The hub may couples the handle to the spindle for imparting rotation from the handle to the spindle. When the actuator engages the hub when the handle is in the open position, it may block any folding movement of the handle from the open position to the closed position as well as any rotational movement of the handle with respect to the hub. Thus, the lockout feature locks the handle in the open position until the homeowner engages the actuator and slides it away from and out of engagement with the hub so the handle can be rotated with respect to the hub and folded or pivoted towards the base of the operator and towards the closed position. Conversely, the actuator is biased towards the hub when the handle is in the closed position as well. Thus, the homeowner must engage the actuator and move it away from the hub to move the handle from the closed position to the open position.

In one aspect, an operator for a casement window is disclosed. The disclosed operator is coupled to a rotatable spindle. The operator may include a hub that includes an opening for frictionally receiving the spindle. The hub may be pivotally connected to a proximal end of a handle. The proximal end of the handle may include a cavity that extends towards a distal end of the handle and that terminates at a back wall. The cavity at least partially accommodates a biasing element, an actuator and the hub. The actuator may include a distal end that faces towards the distal end of the handle and a proximal end that faces the hub. The biasing element may be disposed between the back wall of the cavity and the distal end of the actuator for biasing the actuator towards engagement with the hub. The hub may include an open position recess and an open position protrusion. The handle may be pivotable between open and closed positions. The proximal end of the actuator may include a protrusion and a recess. The protrusion of the actuator may be received in the open position recess of the hub and the recess of the actuator may receive the open position protrusion of the hub when the handle is pivoted to an open position while the operator is biased into engagement with the hub.

In another aspect, another disclosed operator for a casement window is also coupled to a rotatable spindle. The operator may include a hub that may include an opening for frictionally receiving the spindle. The hub may be pivotally connected to a proximal end of a handle. The proximal end of the handle may include a cavity that extends towards a distal end of the handle and that terminates at a back wall. The cavity may accommodate a housing that has a closed distal end and that abuts the back wall and an open proximal end for receiving the actuator. The housing may accommodate a biasing element. The actuator may include a distal end that faces the biasing element and a proximal end that faces the hub. The biasing element may be disposed between the distal end of the actuator and the back wall of the cavity for biasing the actuator towards engagement with the hub. The handle may be pivotable between open and closed positions. The hub may include an open position recess, an open position protrusion, a closed position recess and a closed position protrusion. The proximal end of the actuator may include a protrusion and a recess. The protrusion of the actuator may be received in the open position recess of the hub and the recess of the actuator may receive the open position protrusion of the hub when the handle is pivoted to the open position while the actuator is biased into engagement with the hub. Further, the protrusion of the actuator may be received in the closed position recess of the hub and the recess of the actuator may receive the closed position protrusion of the hub when the handle is pivoted to the closed position while the actuator is biased into engagement with the hub.

In any one or more of the embodiments described above, the hub may include a closed position recess and a closed position protrusion in addition to an open position recess and an open position protrusion. In such an embodiment, the protrusion of the actuator may be received in the closed position recess of the hub and the recess of the actuator may be received in the closed position protrusion of the hub when the handle is pivoted to the closed position.

In any one or more of the embodiments described above, the cavity may accommodate a housing. The housing may have a distal end that engages the back wall of the cavity and the housing may have an open proximal end that receives the distal end of the actuator. Further, the distal end of the housing may include a proximally directed peg. The biasing element may include a spring and may have a distal end that receives the peg and a proximal end that is received in an opening disposed in the distal end of the actuator. In such an embodiment, the housing may be coupled to the handle in the cavity with the distal end of the housing abuttingly engaging the back wall of the cavity.

In any one or more of the embodiments described above, the actuator may include a finger grip to facilitate movement of the actuator distally and away from the hub so the handle can be pivoted from the open position to the closed position, and vice versa.

In any one or more of the embodiments described above, the handle may pivot from about 100° to about 170° with respect to the hub when moving between the open and closed positions.

In any one or more of the embodiments described above, the handle may include a distal end that is coupled to a knob. The knob may have a central axis and the spindle may rotate about an axis that is not coplanar with the central axis of the knob.

In any one or more of the embodiments described above, the proximal end of the handle may be coupled to a pin that extends across the proximal end of the cavity. The hub may include a through hole that receives the pin thereby pivotally coupling the hub to the proximal end of the handle.

In any one or more of the embodiments described above, the actuator may include two protrusions and the recess of the actuator may be disposed between the two protrusions. Further, the hub may include two open position recesses and the open position protrusion may be disposed between the two open position recesses. Further, each of the two protrusions of the actuator may be received in one of the two open position recesses of the hub and the recess of the actuator may receive the open position protrusion of the hub when the handle is pivoted to the open position while the actuator is biased into engagement with the hub.

In any one or more of the embodiments described above, the hub may include two closed position recesses and a closed position protrusion that is disposed between the two closed position recesses. Further, each of the two protrusions of the actuator may be received in one of the closed position recesses of the hub and the recesses of the actuator may receive the closed position protrusion of the hub when the handle is pivoted to the closed position while the actuator is biased into engagement with the hub.

In any one or more of the embodiments described above, the housing may be coupled to the handle with at least one fastener.

In any one or more of the embodiments described above, the actuator may include a body disposed between the proximal and distal ends of the actuator. Further, the opening in the distal end of the actuator may pass into the body. The actuator may also include at least one slot extending from the distal end of the actuator and at least partially along the body of the actuator. The housing may include at least one rail that is slidably received in the slot of the actuator.

In any one or more of the embodiments described above, the handle may pivot through a range of from about 120° to about 150° with respect to the hub when moving between the open and closed positions.

Other features and advantages of this disclosure will be apparent from the following specification taken in conjunction with the following drawings.

BRIEF DESCRIPTION OF THE DRAWINGS

FIG. 2 shows the handle and hub in an open position or a position where rotation of the handle will be imparted to the spindle that is coupled to the operator arms that are shown in FIG. 1.

FIG. 4 also illustrates the handle and hub in the closed position.

FIG. 5 also illustrates the handle and hub as the handle is moved from the closed position shown in FIGS. 3-4 towards the open position shown in FIG. 6.

FIG. 8 also illustrates the initial movement of the handle out of the open position shown in FIGS. 6-7 as the handle is moved towards the closed position shown in FIGS. 3-4.

DESCRIPTION

Figure 1:
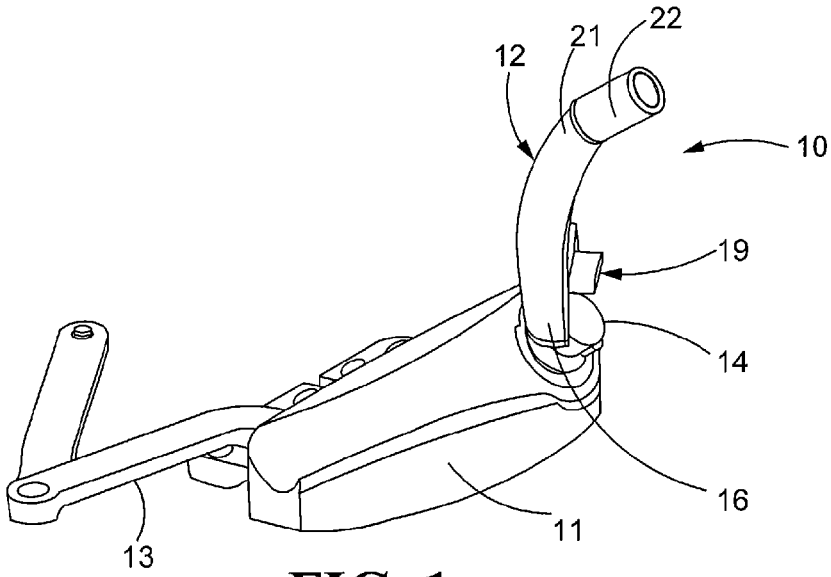
FIG. 1 is a front right perspective view of a disclosed casement window operator.
Figure 3:
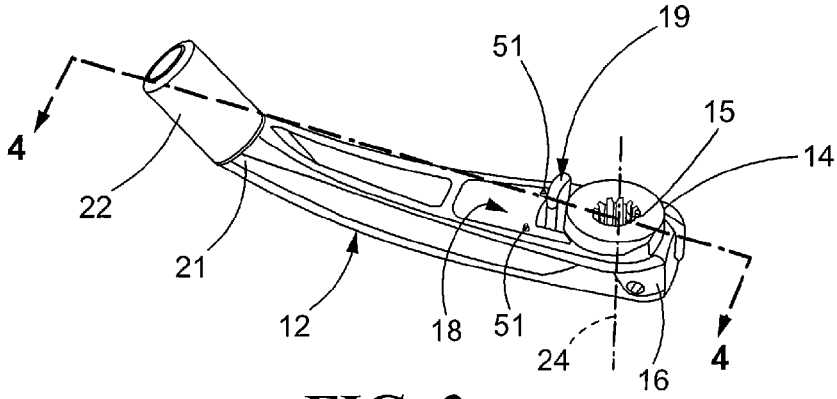
FIG. 3 is another inverted view of the handle and hub of the window operator shown in FIG. 1 but, in contrast to FIG. 2, the handle and hub shown in FIG. 3 are in the closed position.

FIG. 1 is a perspective view of a disclosed casement window operator 10 which includes a base 11, a handle 12 and one or more operator arms 13. The handle is pivotally connected to a hub 14. The hub 14 includes a splined central opening 15 as shown in FIG. 3. The splined opening 15 frictionally accommodates a spindle (not shown) which is operatively coupled to the operator arm 13. Rotation of the handle 12 imparts rotation to the hub 14 and therefore the spindle (not shown). Rotation of the spindle (not shown) results in pivotal/rotational movement of the arm 13. The arm 13 may be indirectly or directly coupled to a casement window sash. The pivotal/rotational movement imparted to the arm 13 results in opening or closing of the window sash (not shown).

Figure 2:
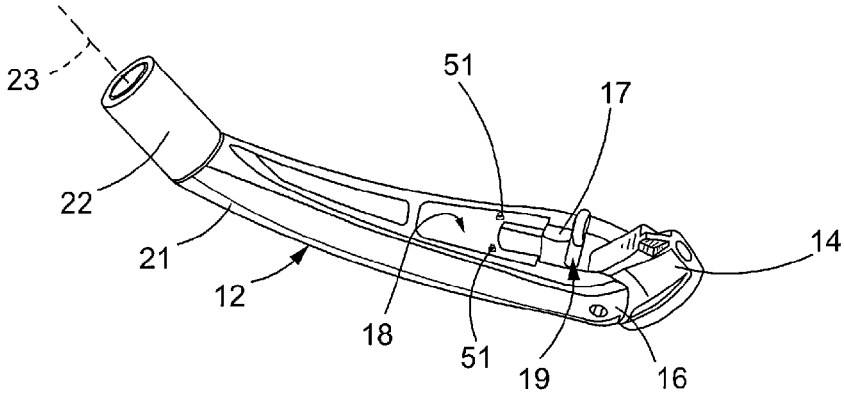
FIG. 2 is a partial, inverted view of the operator shown in FIG. 1, particularly illustrating the operator handle as pivotally connected to a hub that frictionally engages a spindle that is coupled to the operator arms shown in FIG. 1.

Referring to FIGS. 1-3, the handle 12 includes a proximal end 16 which includes a cavity 17 (FIG. 2) that at least partially accommodates a housing 18, an actuator 19 and the hub 14 as illustrated in FIG. 3. The handle 12 also includes a distal end 21 which may be coupled to a knob 22. As noted above, part of the problem associated with folding handle-type window operators is the tendency of the handle to move from the open position shown in FIG. 1 to the closed position shown in FIG. 3 while the homeowner or user is attempting to open or close the window. This tendency is caused by the axis 23 of the knob 22 being out of plane with the axis 24 of the spindle (not shown) or the opening 15 of the hub 14 as shown in FIGS. 2 and 3. In other words, the homeowner typically operates the handle 12 by gripping the knob 22. Imparting a circular movement to the knob 22 results in an axial rotation of the hub 14 about the axis 24 (FIG. 3) of the hub 14 or the spindle (not shown). Because the axis 23 (FIG. 2) and the axis 24 (FIG. 3) are not coplanar, the force imparted to the knob 22 by the homeowner can result in an unwanted pivoting of the handle from the open position shown in FIG. 2 back towards the closed position shown in FIG. 3.

Figure 4:
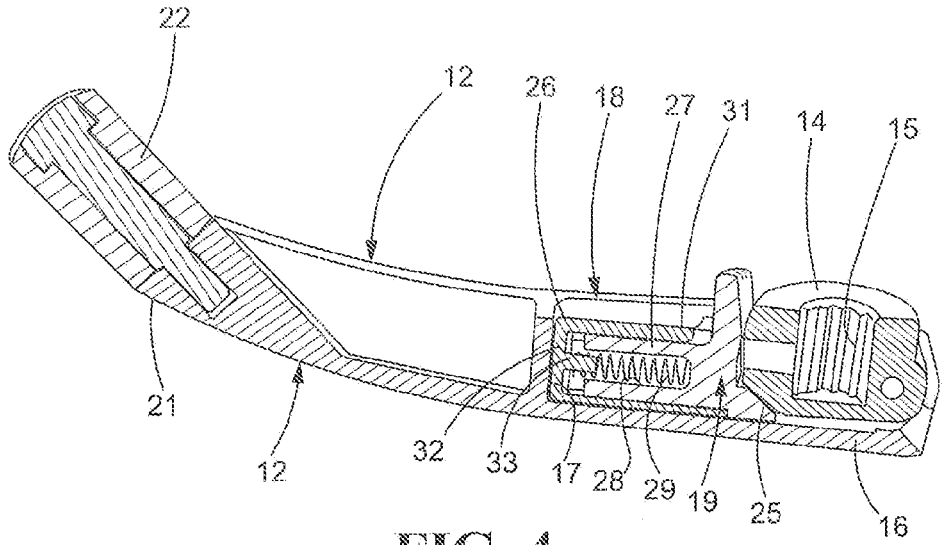
FIG. 4 is a sectional view taken substantially along line 4-4 of FIG. 3.

To alleviate this problem, the operator 10 is equipped with a lockout feature that will be explained in connection with FIGS. 4-9. Turning first to FIG. 4, the handle 12 and hub 14 are shown in the closed position. The lockout feature includes the actuator 19. The actuator 19 include a proximal end 25, a distal end 26 and a body 27 extending therebetween. The body 27 may include an opening 28 which extends through the distal end 26. The opening 28 may accommodate a biasing element, such as the spring 29. Further, the housing 18 may also include a proximal end 31 and a distal end 32. The proximal end 31 of the housing 18 may be open for receiving the body 27 of the actuator 19. The distal end 32 of the housing 18 may be closed and may further include a proximally extending peg 33. The peg 33 may accommodate a distal end of the spring 29 while the remainder of the spring 29 extends through the opening 28 in the body 27 of the actuator 19 and towards the proximal end 25 of the actuator 19. Thus, the body 27 of the actuator 19 acts as a spring biased plunger. The spring 29 biases the actuator 19 and the proximal end 25 of the actuator 19 towards engagement with the hub 14.

Figure 5:
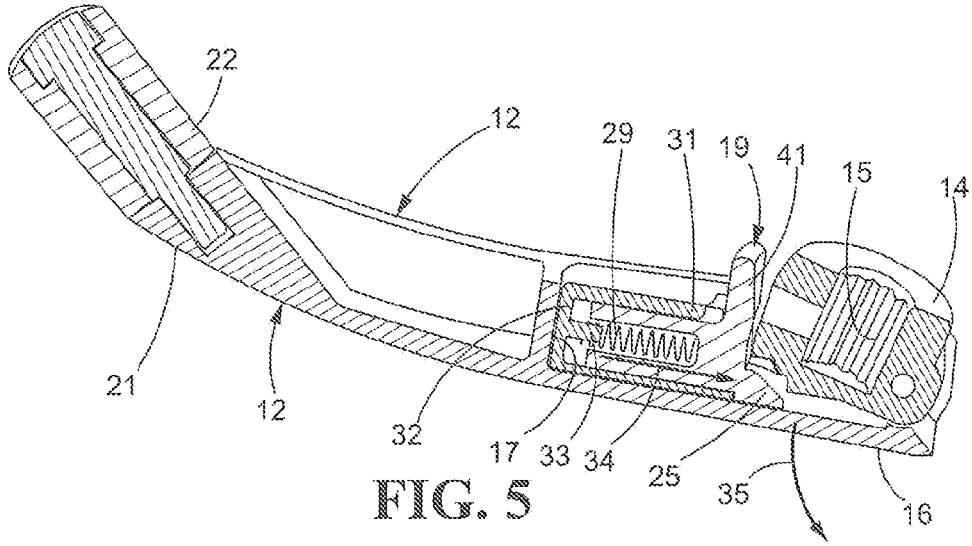
FIG. 5 is a sectional view also taken substantially along line 4-4 of FIG. 3.
Figure 6:
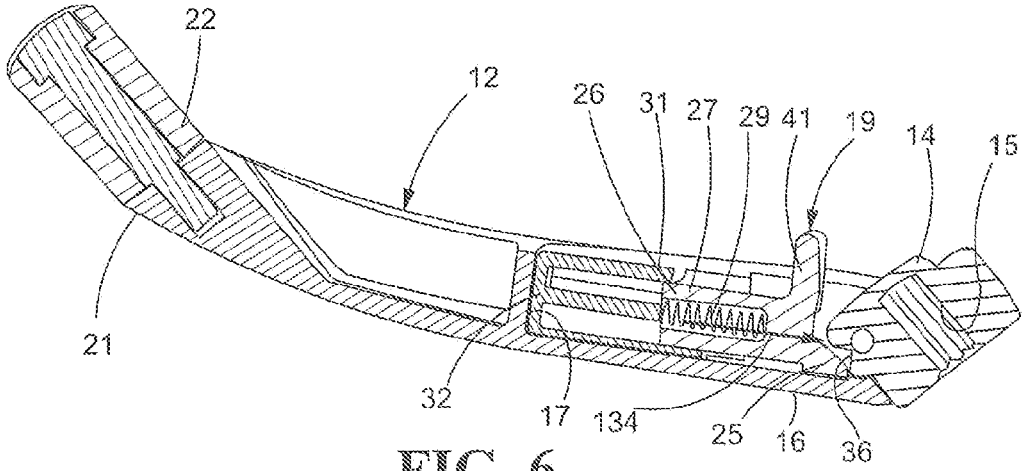
FIG. 6 is another sectional view taken substantially along line 4-4 of FIG. 3 but with the handle and hub in the open position.

In the embodiment shown, to move the handle 12 from the closed position shown in FIG. 4 to the open position shown in FIG. 6, the handle 12 is pivoted away from the base 11 (FIG. 1) towards the position shown in FIG. 6. As the handle 12 is pivoted upward in the orientation of FIG. 1, the spring 29 biases the actuator 19 towards the hub 14 as indicated by the arrow 34 (FIG. 5). The pivotal movement of the handle 12 away from the hub 14 is indicated by the arrow 35. The handle 12 continues to be lifted or pivoted away from the hub 14 until it reaches the open position shown in FIG. 6. The bias of the spring 29 (FIG. 5) causes the actuator 19 to move in the direction of the arrow 134 as shown in FIG. 6 until the proximal end 25 of the actuator 19 engages one or more open position recesses 36 which are best seen in FIG. 11. An open position protrusion 37 may be disposed between the open position recesses 36. As also shown in FIG. 11, the proximal end 25 of the actuator 19 includes a pair of protrusions 38 and a recess 39 disposed between the protrusion 38. In the open position, the protrusions 38 are received in the open position recesses 36 of the hub 14 and the open position protrusion 37 of the hub 14 is received in the recess 39 of the actuator 19. This engagement in the open position is a result of the biasing force of the spring 29.

Figure 11A:
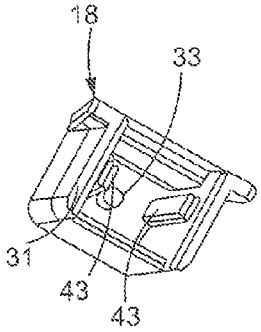
FIGS. 11A-11C are front perspective views of the housing, actuator and hub respectively.
Figure 11B:
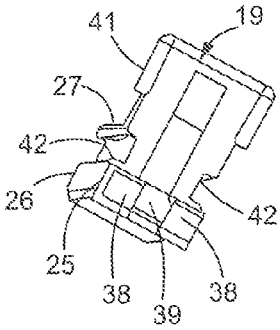
Figure 11C:
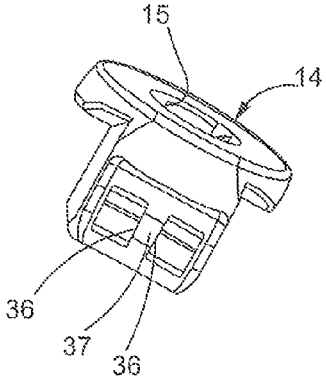

Referring to FIGS. 11A-12C, the actuator 19 includes an upwardly extending finger grip 41. Further, the body 27 of the actuator 19 includes opposing slots 42. The slots 42 receive the rails 43 that are disposed inside the housing 18 as shown in FIG. 11A. Thus, the open proximal end 31 of the housing 18 receives the distal end 26 of the actuator 19 and the slots 42 disposed along the body 27 of the actuator 19 receive the rails 43 of the housing 18. Further, the distal end 26 of the actuator 19 also includes an opening 44 which receives at least part of the biasing element or spring 29.

Figure 12A:
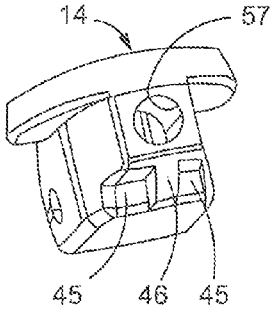
FIGS. 12A-12C are rear perspective views of the hub, actuator and housing respectively.
Figure 12B:
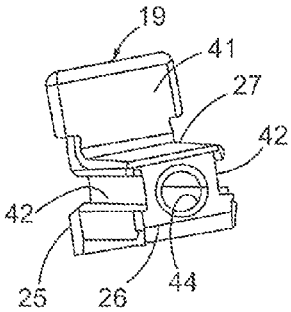
Figure 12C:
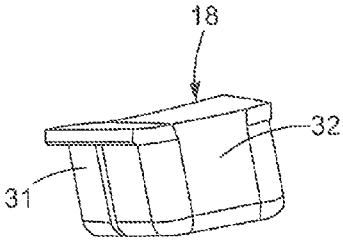

Referring to FIG. 12A, the hub 14 also includes closed position recesses 45 with a closed position protrusion 46 disposed therebetween. The closed position recesses 45 receive the protrusions 38 of the proximal end 25 of the actuator 19 when the handle is pivoted to the closed position as shown in FIGS. 3-4. Further, the recess 39 of the proximal end 25 of the actuator 19 receives the closed position protrusion 46 of the hub 14 when the handle has been pivoted to the closed position as shown in FIGS. 3-4.

Figure 7:
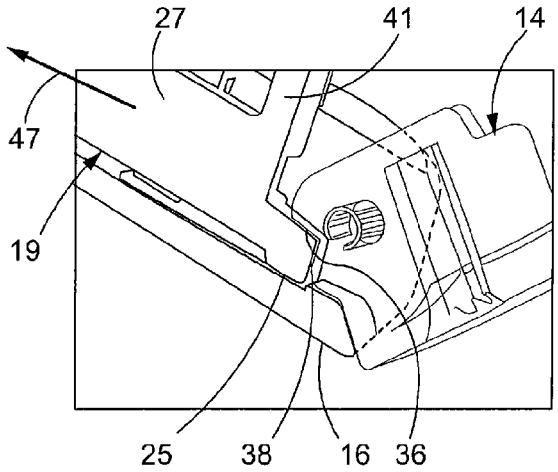
FIG. 7 is a partial expanded view of the proximal end of the handle, the actuator and the engagement between the actuator and hub when the handle and hub are in the open position.
Figure 8:
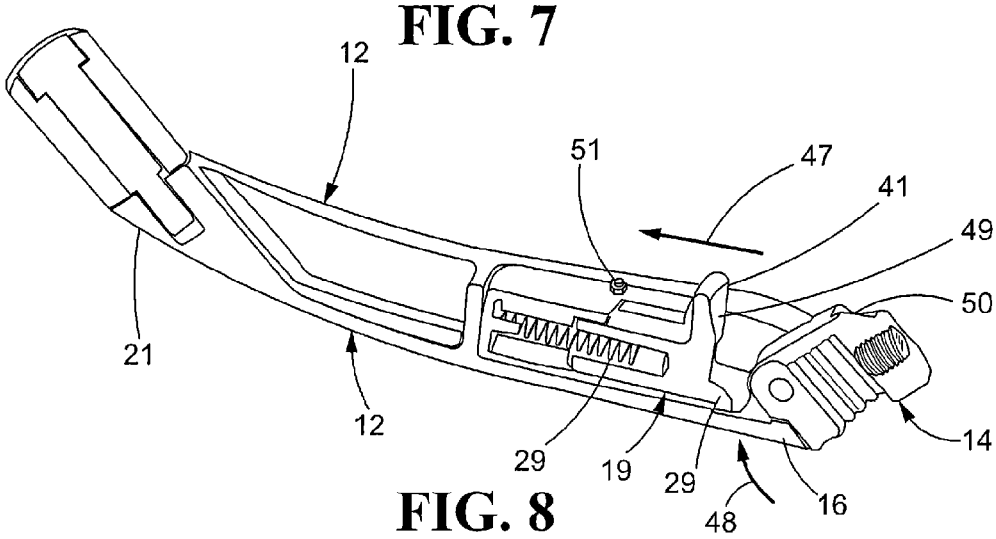
FIG. 8 is yet another sectional view taken substantially along line 4-4 of FIG. 3.
Figure 9:
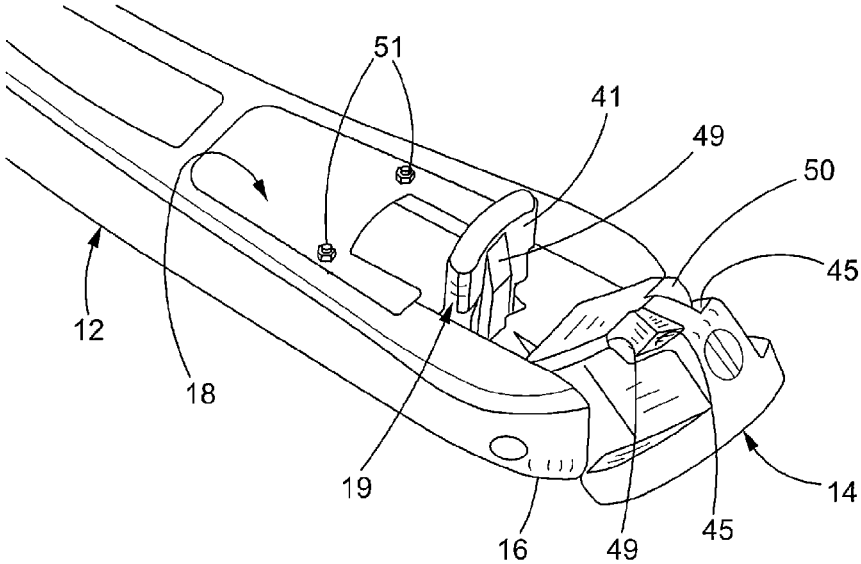
FIG. 9 is a partial perspective view of the distal end of the handle, actuator and hub illustrating the finger grip of the actuator and movement of the actuator away from the hub thereby permitting pivotal and rotational movement of the handle with respect to the hub as the handle is moved from the open to the closed position, and vice versa.

Thus, referring to FIG. 7, in the open position as shown in FIGS. 6-7, the protrusions 38 disposed at the proximal end 25 of the actuator 19 are biased towards and are received in the open position recesses 36 of the hub 14. In the open position as shown in FIGS. 6-7, reverse pivotal movement of the handle 12 from the open position shown in FIGS. 6-7 back towards the closed position shown in FIGS. 3-4 is not possible without releasing the actuator 19 or releasing the protrusions 38 of the actuator 19 from the open position recesses 36 of the hub 14. To release the actuator 19, the finger grip 41 is engaged by the homeowner or user and is pushed in a distal direction or in a direction indicated by the arrow 47 as shown in FIG. 7. Once the protrusions 38 are released from the recesses 36 and the protrusion 37 is released from the recess 39 (FIG. 11B), the handle 12 is free to pivot from the open position shown in FIGS. 6-7 back from the closed position shown in FIGS. 3-4 as indicated by the arrow 48 shown in FIG. 8. Further, the ramped surfaces 49 of the finger grip 41 of the actuator 19 and the ramped surfaces 50 of the closed position recesses 45 of the hub 14 freely allow the actuator 19 to be pushed against the bias of the spring 29 as the handle 12 is rotated from the open position shown in FIGS. 6-8 back towards the closed position of FIGS. 3-4. Turning to FIG. 9, it will be noted that the housing 18 may be secured to the handle 12 by one or more fasteners 51.

Figure 10:
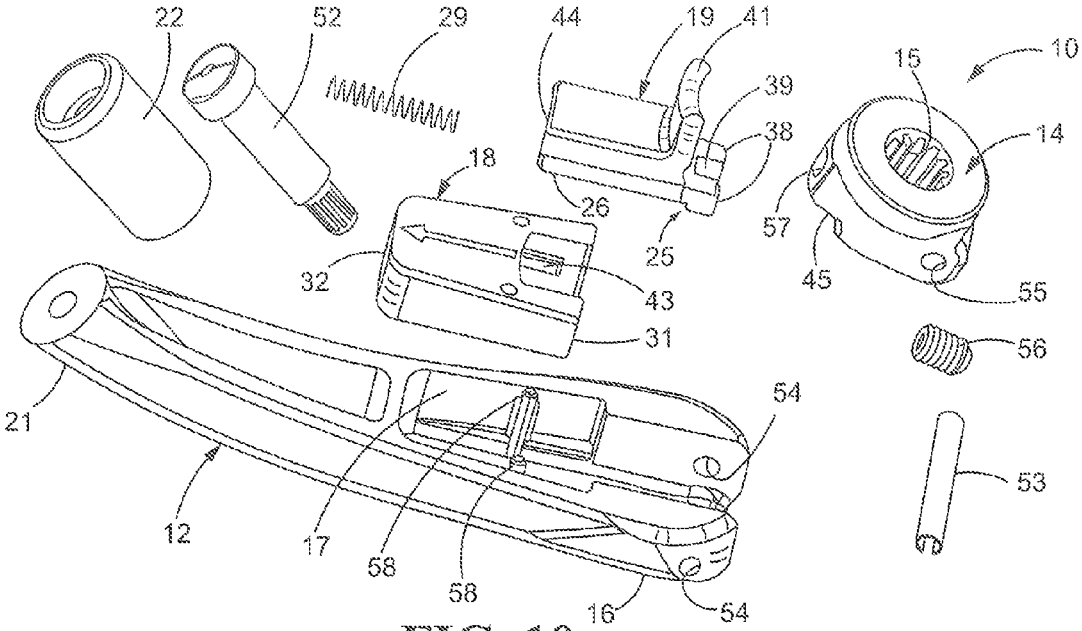
FIG. 10 is an exploded view of the components of the handle, the actuator, the actuator housing and the hub.

Turning to FIG. 10, the disclosed operator 10 is shown in an exploded view. A total of nine parts may be incorporated into the operator 10, including: the hub 14; the actuator 19; the biasing element or spring 29; the housing 18; the knob 22; the handle 12; the fastener 52 which secures the knob 22 to the distal end 21 of the handle 12; the pivot 53 which is received in the openings 54 disposed at the proximal end 16 of the handle 12 and which passes through the openings 55 disposed in the hub 14 for purposes of securing the hub 14 to the proximal end 16 of the handle 12; and a set screw 56 which is received in the opening 57 disposed in the hub 14 for purposes of securing the hub 14 to the spindle (not shown). It will be noted that the fasteners 51 that may be used to secure the housing 18 to the handle 12 may be received in openings 58 provided on the handle 12 or in the cavity 17 as shown in FIG. 10.

INDUSTRIAL APPLICABILITY

Disclosed herein is an improved operator 10 that features a foldable handle 12 which may be pivoted between open and closed positions. The open position for the handle 12 is shown in FIGS. 1-2 and 6-9. The closed position for the handle 12 is illustrated in FIGS. 3-4. FIG. 5 illustrates the initiation of pivotal movement of the handle 12 from the closed position as shown in FIGS. 3-4 towards the open position as shown in FIGS. 2 and 6-9. To prevent the handle 12 from folding back towards the closed position when the homeowner or user is rotating the handle 12 for purposes of opening or closing the window, the disclosed operator 10 includes a lockout feature. The lockout feature includes an actuator 19 with a proximal end 25 that selectively engages the hub 14 when the handle 12 is moved to the open or closed positions. More specifically, in the open position shown in FIGS. 1-2 and 6-9, the handle 12 is ready to be rotated by the homeowner or user for purposes of opening or closing a window sash. In the open position, at least one protrusion 38 disposed at the proximal end 25 of the actuator is received in at least one open position recess 36 disposed on the hub 14 and the proximal end 25 of the actuator 19 also receives at least one protrusion 37 disposed on the hub, when the handle 12 is in the open position. By using a combination of at least one recess 36 and at least one protrusion 37 on the hub and at least one recess 39 and at least one protrusion 38 on the actuator 19, the handle 12 may be prevented from pivoting back towards the closed position or rotating towards the closed position when the handle 12 is in the open position.

Similarly, in the closed position as shown in FIGS. 3-4, the proximal end 25 of the actuator 19 engages the closed position recesses 45 and the closed position protrusion 46 disposed on the hub 14. More specifically, the protrusions 38 of the actuator 19 are received in the closed position recesses 45 and the closed position protrusion 46 disposed on the hub 14 is received in the recess 39 of the actuator 19. Again, by using a combination of at least one recess 45 and at least one protrusion 38 on the hub 14, and at least one recess 39 and at least one protrusion 46 on the handle 12, the handle 12 is prevented from pivoting with respect to the hub 14 and is also prevented from rotating with respect to the hub 14 when the handle 12 is in the closed position as shown in FIGS. 3-4. The lockout feature can be easily overridden by engaging the finger grip 41 provided on the actuator 19 and sliding the actuator 19 in a distal direction away from the hub 14 as indicated by the arrow 47 in FIG. 8. Otherwise, the actuator 19 is spring biased into engagement with the hub 14 as indicated by the arrows 34, 134 in FIGS. 5-6.

The invention claimed is:

1. An operator for a casement window, the operator being coupled to a rotatable spindle, the operator comprising:

a hub including an opening for frictionally receiving the spindle, the hub being pivotally connected to a proximal end of a handle;

the proximal end of the handle including a cavity that extends towards a distal end of the handle and terminates at a back wall, the cavity at least partially accommodating a biasing element, an actuator and the hub;

the actuator including a distal end that faces towards the distal end of the handle and a proximal end that faces the hub, the biasing element being disposed between the back wall and the distal end of the actuator for biasing the actuator towards engagement with the hub;

the hub including an open position recess and an open position protrusion;

the handle being pivotable between open and closed positions, the proximal end of the actuator including a protrusion and a recess, the protrusion of the actuator being received in the open position recess of the hub and the recess of the actuator receiving the open position protrusion of the hub when the handle is pivoted to an open position while the actuator is biased into engagement with the hub, and wherein the hub further includes a closed position recess and a closed position protrusion, the protrusion of the actuator being received in the closed position recess of the hub and the recess of the actuator receiving the closed position protrusion of the hub when the handle is pivoted to the closed position.

2. The operator of claim 1 wherein the cavity accommodates a housing, the housing having a distal end that engages the back wall of the cavity and the housing having an open proximal end that receives the distal end of the actuator, the distal end of the housing including a peg, the biasing element including a spring having a distal end that receives the peg and a proximal end that is received in an opening disposed in the distal end of the actuator.

3. The operator of claim 2 wherein the housing is coupled to the handle in the cavity with the distal end of the housing abuttingly engaging the back wall of the cavity.

4. The operator of claim 3 wherein the housing is coupled to the handle with at least one fastener.

5. The operator of claim 2 wherein the actuator includes a body disposed between the proximal and distal ends of the actuator, the opening in the distal end of the actuator passing into the body, the actuator including at least one slot extending from the distal end of the actuator and at least partially along the body, the housing including at least one rail that is slidably received in the slot of the actuator.

6. The operator of claim 1 wherein the actuator includes a finger grip to facilitate movement of the actuator distally and away from the hub so the handle can be pivoted from the open position to the closed position.

7. The operator of claim 2 wherein the handle pivots from about 100° to about 170° with respect to a central axis of the hub when moving between the open and closed positions.

8. The operator of claim 1 wherein the handle includes a distal end that is coupled to a knob, the knob having a central axis and the spindle may rotate about an axis that is not coplanar with the central axis of the knob.

9. The operator of claim 1 wherein the proximal end of the handle is coupled to a pin that extends across the proximal end of the cavity, the hub including a through hole that receives the pin thereby pivotally coupling the hub to the proximal end of the handle.

10. The operator of claim 1 wherein the actuator includes two protrusions and the recess of the actuator is disposed between the two protrusions;

the hub including two open position recesses and the open position protrusion is disposed between the two open position recesses;

each of the two protrusions of the actuator being received in one of the two open position recesses of the hub and the recess of the actuator receiving the open position protrusion of the hub when the handle is pivoted to the open position while the actuator is biased into engagement with the hub.

11. The operator of claim 10 wherein the hub includes two closed position recesses and a closed position protrusion that is disposed between the two closed position recesses;

each of the two protrusions of the actuator being received in one of the closed position recesses of the hub and the recess of the actuator receives the closed position protrusion of hub when the handle is pivoted to the closed position while the actuator is biased into engagement with the hub.

12. An operator for a casement window, the operator being coupled to a rotatable spindle, the operator comprising:

a hub including an opening for frictionally receiving the spindle, the hub being pivotally connected to a proximal end of a handle;

the proximal end of the handle including a cavity that extends towards a distal end of the handle and terminates at a back wall, the cavity accommodating a housing having a closed distal end that abuts the back wall and an open proximal end for receiving an actuator, the housing accommodating a biasing element;

the actuator including a distal end that faces the biasing element and a proximal end that faces the hub, the biasing element being disposed between the back wall of the cavity and the distal end of the actuator for biasing the actuator towards engagement with the hub;

the handle being pivotable between open and closed positions, the hub including an open position recess, an open position protrusion, a closed position recess and a closed position protrusion, the proximal end of the actuator including a protrusion and a recess;

the protrusion of the actuator being received in the open position recess of the hub and the recess of the actuator receiving the open position protrusion of the hub when the handle is pivoted to the open position while the actuator is biased into engagement with the hub; and the protrusion of the actuator being received in the closed position recess of the hub and the recess of the actuator receiving the closed position protrusion of the hub when the handle is pivoted to the closed position while the actuator is biased into engagement with the hub.

13. The operator of claim 12 wherein the distal end of the housing includes a peg, the biasing element includes a spring having a distal end that receives the peg and a proximal end that is received in an opening disposed in the distal end of the actuator.

14. The operator of claim 12 wherein the housing is coupled to the handle in the cavity with the distal end of the housing abuttingly engaging the back wall of the cavity.

15. The operator of claim 12 wherein the actuator includes a finger grip to facilitate movement of the actuator away from the hub so the handle can be pivoted from the open position to the closed position.

16. The operator of claim 12 wherein the handle pivots from about 120° to about 150° with respect to a central axis of the hub when moving between the open and closed positions.

17. The operator of claim 12 wherein the handle includes a distal end that is coupled to a knob, the knob having a central axis and the spindle rotating about an axis that is not coplanar with the central axis of the knob.

18. The operator of claim 12 wherein the actuator includes two protrusions and the recess of the actuator is disposed between the two protrusions;

the hub includes two open position recesses and the open position protrusion is disposed between the two open position recesses, the hub also includes two closed position recesses and the closed position protrusion is disposed between the two closed position recesses;

each of the two protrusions of the actuator being received in one of the two open position recesses of the hub and the recess of the actuator receiving the open position protrusion of the hub when the handle is pivoted to the open position while the actuator is biased into engagement with the hub; and each of the two protrusion of the actuator being received in one of the closed position recesses of the hub and the recess of the actuator receives the closed position protrusion of hub when the handle is pivoted to the closed position while the actuator is biased into engagement with the hub.

19. The operator of claim 13 wherein the actuator includes a body disposed between the proximal and distal ends of the actuator, the opening in the distal end of the actuator passing into the body, the actuator including at least one slot extending from the distal end of the actuator and at least partially along the body, the housing including at least one rail that is slidably received in the slot of the actuator.

* * * * *